United States Patent [19]

Stewart

[11] 4,253,717

[45] Mar. 3, 1981

[54] CRT SOCKET

[75] Inventor: David S. Stewart, Palatine, Ill.

[73] Assignee: True-Line Mold & Engineering Corporation, Rosemont, Ill.

[21] Appl. No.: 63,801

[22] Filed: Aug. 6, 1979

[51] Int. Cl.[3] ..... H01J 19/66

[52] U.S. Cl. ..... 339/14 T; 339/105; 339/111; 339/145 T; 339/192 T; 339/193 S; 339/206 L

[58] Field of Search ..... 339/105, 111, 144 T, 339/145 T, 192 R, 192 T, 193 R, 193 S, 206 L, 14 T

[56] References Cited

U.S. PATENT DOCUMENTS

| | | | |
|---|---|---|---|
| 3,240,980 | 3/1966 | Schuster | 339/193 R |
| 3,502,933 | 3/1970 | Leimontas et al. | 339/144 T |
| 3,636,412 | 1/1972 | Simovits et al. | 339/111 |
| 3,716,819 | 2/1973 | Borth | 339/193 R |
| 3,865,452 | 2/1975 | Pittman | 339/111 |
| 3,867,670 | 2/1975 | Schor et al. | 339/111 |
| 3,916,238 | 10/1975 | Suzuki | 339/193 R |
| 3,958,854 | 5/1976 | Arrington et al. | 339/111 |
| 4,054,346 | 10/1977 | Schultz | 339/145 T |

FOREIGN PATENT DOCUMENTS

| | | | |
|---|---|---|---|
| 1395832 | 5/1975 | United Kingdom | 339/111 |

*Primary Examiner*—John McQuade

*Attorney, Agent, or Firm*—Trexler, Wolters, Bushnell & Fosse, Ltd.

[57] ABSTRACT

There is disclosed a new and improved socket for making electrical connections to the pins on the neck of a cathode ray tube. The improvement includes a plurality of first conductive contacts which are arranged to engage the pins of the cathode ray tube and which include an elongated planar portion from which a cylindrical projection is integrally formed. A second conductive contact which is also planar in configuration includes a corresponding plurality of holes therein. Each of the holes has a diameter larger than the diameter of the cylindrical projections for receiving a corresponding one of the cylindrical projections. The improved socket further includes a planar insulating member positioned between the first and second conductive contacts and having a corresponding plurality of holes therein. Each of the holes of the insulating member has a diameter smaller than the corresponding hole in the second conductive contact but at least as large as the diameter of the corresponding cylindrical projections. As a result, a spark gap is formed radially from each cylindrical projection to the periphery of each hold in the second contact.

7 Claims, 9 Drawing Figures

CRT SOCKET

BACKGROUND OF THE INVENTION

The present invention is generally directed towards a socket for making electrical connections to the pins on the neck of a cathode ray tube, and more particularly to an improved spark gap structure for such a socket.

As well known, during the operation of a cathode ray tube, sparking or arc-over within such tubes often results. The sparking or arc-over usually occurs within the cathode ray tube gun structures and is generally caused by the high voltages applied to the elements of the guns. Such arcing results in surge voltages and currents being applied to the external pins of a cathode ray tube which, if of high enough voltage or current, can sometimes cause serious damage to the electronic circuitry connected thereto.

In the past, the problem of cathode ray tube arcing was not as serious as it is now because, in the case of a television receiver for example, the television circuitry external to the cathode ray tube comprised vacuum tubes. Vacuum tubes generally are capable of withstanding momentary voltage or current surges without being seriously damaged or destroyed. However, such is not the case with solid-stage circuitry.

In recent years, solid-state circuitry for television receivers has become increasingly popular. The popularity of solid-state television receivers generally has been due to their reduced power consumption as compared to their tube counterparts, longer useful life, greater reliability, and their "instant on" operation. However, solid-state components such as transistors are more susceptible to being damaged by voltage and current surges than are tubes. As a result, it is often desirable to provide some means for preventing the solid-state components from the surge voltages and currents resulting from cathode ray tube arcing.

In providing such protection, resort was had to spark gaps for dissipating surge voltages and currents to ground potential which resulted from the aforementioned arcing within cathode ray tubes. For example, spark gaps within the cathode ray tubes themselves were attempted but eventually discarded for being too costly. Eventually, it was found that spark gaps could be incorporated within the cathode ray tube sockets which connect the pins thereof to the external circuitry. While such sockets have proven to be both generally effective and commercially feasible, there remains substantial room for improvement.

For example, in order to minimize the production costs of tube sockets incorporating spark gaps, the electrodes of the spark gaps have been rather crudely stamped or formed on a high volume basis resulting in random sharp edges on the electrodes. These sharp edges, in many instances, have promoted arcing themselves and, because of their random nature, have not provided consistent arc-over voltage protection. Furthermore, cathode ray tube sockets having such spark gaps have been somewhat complex, comprising a plurality of small component parts to form the spark gaps. As a result, the materials, molding, and assembly costs of such sockets, even on a mass production basis, have been inordinately high.

It is therefore a general object of the present invention to provide a new and improved socket for making electrical connection to the pins of a cathode ray tube.

It is a further object of the present invention to provide a new and improved socket for making electrical connections to the pins on the neck of a cathode ray tube which includes an improved spark gap structure for protecting external solid-state circuitry or the like.

It is a more particular object of the present invention to provide such a socket which minimizes the number of component parts required in forming the spark gaps to the end of reducing the cost of manufacturing the sockets.

It is a more particular object of the present invention to provide such a socket wherein the spark gaps are so formed that reliable and consistent surge voltage and current protection is afforded to the external circuitry connected thereto.

SUMMARY OF THE INVENTION

In accordance with the invention, a new and improved socket for making electrical connections to the pins on the neck of a cathode ray tube is provided which includes the improvement comprising a plurality of first conductive contacts for engaging the pins, wherein each of the contacts has an elongated planar portion a part of which is integrally formed into a cylindrical projection from the plane of the elongated portion. The improvement further includes a second conductive contact having a planar surface with a corresponding plurality of holes therein, with each of the holes having a diameter larger than that of the cylindrical projections for receiving a corresponding one of the cylindrical projections, and a planar insulating member positioned between the first and second conductive contacts and having a corresponding plurality of holes therein. Each of the holes of the planar insulating member has a diameter smaller than the corresponding hole in the planar conductive contact but at least as large as the diameter of the corresponding cylindrical projection. As a result, a spark gap is formed radially from each cylindrical projection to the periphery of its associated hole in the second contact.

BRIEF DESCRIPTION OF THE DRAWINGS

The invention, together with further objects and advantages thereof, may best be understood by making reference to the following description taken in conjunction with the accompanying drawings, wherein the several figures of which like reference numerals indicate identical elements, and wherein.

DESCRIPTION OF THE PREFERRED EMBODIMENT

Figure 1:
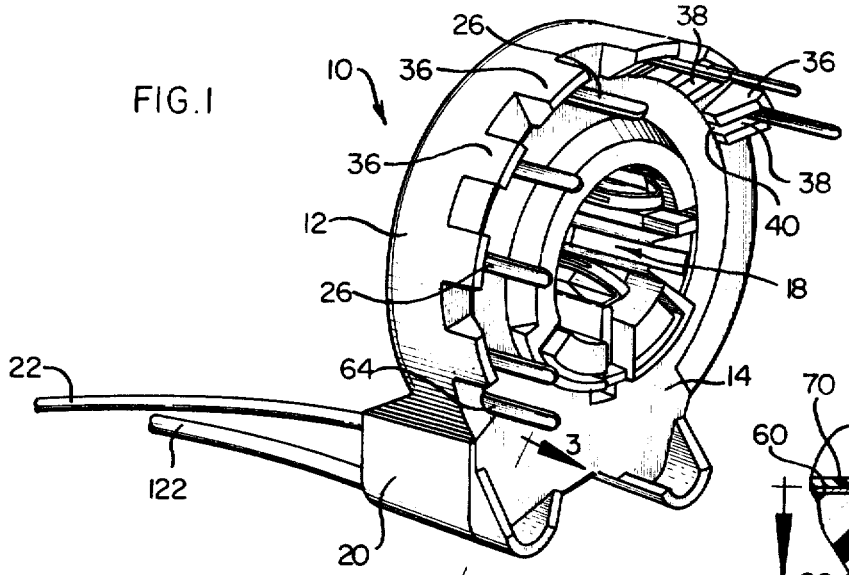
FIG. 1 is a perspective view, to an enlarged scale, of a cathode ray tube socket embodying the present invention.
Figure 2:
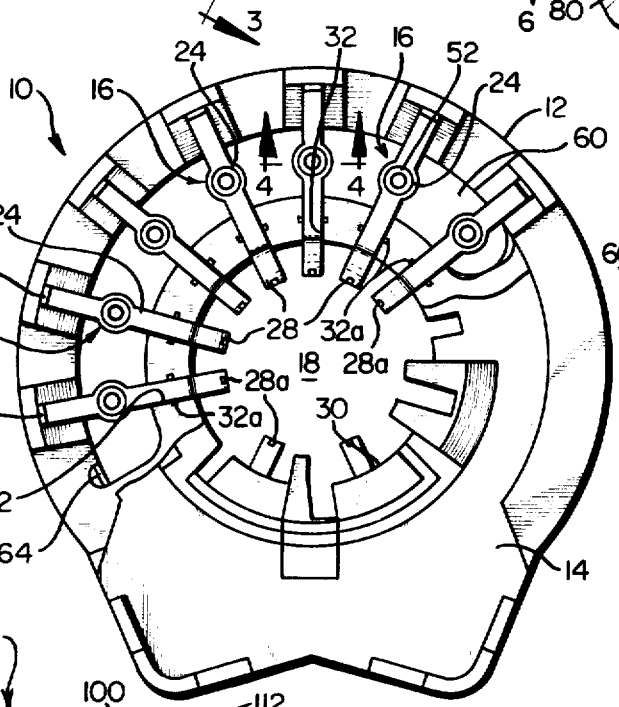
FIG. 2 is a rearward plan view of the socket of FIG. 1 with a portion of the back cover thereof cut away to expose the internal structure of the socket.

Reference is first directed to FIGS. 1 and 2 where a preferred embodiment of a cathode ray tube socket 10 embodying the present invention is illustrated. The socket is of a compact design and primarily includes a pair of interlocking housing pieces comprising a substantially disc-shaped shell or housing 12 and a cover 14. The shell 12 and cover 14 may be conveniently formed in or molded in simple draw molds. The housing 12 has a central opening 18 suitably dimensioned for receiving the neck of a cathode ray tube (not shown). The housing 12 also includes a base portion 20 which, as will be more fully described hereinafter, includes a plurality of bores for receiving insulated high voltage cables 122 and associated ground connecting wires 22.

A plurality of first conductive contacts 16 are angularly spaced and radially disposed between the central opening 18 and the periphery of the housing 12 of the socket 10. Each of the contacts 16 includes an elongated planar portion 24, an extension 26 extending rearwardy from the socket in a generally axial disposition, and contact portions 28 projecting into the central opening 18 for engaging the cathode ray tube pins.

The opening 18 of the socket 10 is defined by a generally cylindrical surface 30. Within the surface 30 there are a plurality of slots 32 wherein each slot 32 is associated with a given one of the first contacts 16 to position the contact portions 28 within the central opening 18. The contact portions 28 may be bifurcated to include slots **28*a* and preferably bent in a generally eliptical configuration to provide a wiping action against the pins of the cathode ray tube upon engagement therewith. More specifically, the contact portions 28 are arranged in a double cantilever manner with the housing 12. As will be noted from FIG. 2, each of the slots 32 includes a transverse, radially outer slot portion 32*a* which receive the free ends of the contact portions 28. As a result, when the cover 14 is assembled to the shell 12, the contact portions 28 are captive to the housing at both ends but their free ends are free to slide permitting free collapse and return of the contact portions upon engagement with and disengagement from the pins of a cathode ray tube. Furthermore, the collapse of the contact portions 28 is consistent with the direction of the socket insertion to the cathode ray tube neck to prevent buckling of the contacts. The extensions 26 form terminals to facilitate the connection of the cathode ray tube pins to external circuitry. More specifically, the extensions 26 form terminals which may receive and support a printed circuit board (not shown) having external circuitry thereon. As can be best noted in FIG. 1, the housing 12 includes a plurality of axially extending support structures 36, with each such structure 36 including a slot 38 dimensioned for receiving an associated one of the terminals 26. Further, the cover 14 includes a plurality of radially extending portions 40 which are arranged to enter the slots 38 upon assembly of the socket. As a result, when the back cover 14 is applied to the housing 10, the radial projections 40 enter the slots 38 and render the terminals 26 rigid for supporting a printed circuit board or the like. The structures 36** further raise the socket from its printed circuit board mounted thereto permitting production washing of the printed circuit boards without entrapment.

Figure 4:
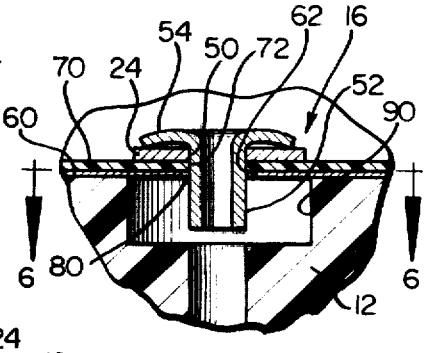
FIG. 4 is a partial cross-sectional view taken generally along lines 4—4 of FIG. 2.

Referring now to FIGS. 2 and 4, it can there be seen that the elongated planar portions of the first contacts 16 include a bore 50 which is dimensioned to receive a conductive cylindrical member 52 in an interference fit relation. The interference fit between the cylindrical member 52 and the bores 50 within planar portions 24 of the first contact 16 assures electrical connection therebetween.

The socket 10 also includes a second conductive contact 60 which is semicircular in configuration and substantially planar. The second conductive contact includes a corresponding plurality of holes 62 which are larger in diameter dimension than the diameter dimension of the cylindrical members 52. The holes 62 of the second conductive contact 60 are arranged so that each hole 62 corresponds to a respective one of the bores 50 of the first contacts 16 and cylindrical members 52. Each cylindrical member 52 also is formed to have an annular flange 54 which is larger in diameter dimension than the corresponding bore 50 to mechanically secure and to further electrically connect the cylindrical members 52 with the first contacts 16.

Positioned between the first and second conductive contacts is a planar insulating member 70 which is also semi-circular and planar in configuration and includes a corresponding plurality of apertures 72. Each aperture 72 corresponds to a respective one of bores 50 of contacts 16, holes 62 of a second contact 60, and cylindrical members 52. Each aperture 72 is smaller in diameter than the corresponding hole of the planar conductive contact 60 but at least as large as the diameter of the corresponding cylindrical member 52. As a result, a spark gap is formed radially from the periphery of each cylindrical member 52 to the periphery of each hole 62 in the second contact member 60. The cylindrical members 52 may comprise, for example, standard eyelets which are commonly manufactured to close diametric tolerances and low in cost. As can be seen in FIG. 4, the spark gap radially transverses an annular space 80. A specific feature resulting from the socket structure as discussed above is that the thickness of the insulating member 70 is not critical in contrast to prior art sockets. The insulating member 70 need only be thick enough to provide the required insulation at the normal operating voltages of the cathode ray tube and has no effect on the desired spark-over potential.

The second conductive contact 60 includes a terminal extension 64 which may, for example, be connected to a reference potential, such as ground potential, for dissipating the surge voltages and currents resulting from arcing across spark gaps 80. Inasmuch as the terminal 64 is common to all of the spark gaps formed by this inventive structure, only one such ground connection for each of the cathode ray tube pins is required. The ground contact extension 64 can have either radial or axial (as shown) breakout from the socket in a convenient manner as circumstances dictate.

Figure 5:
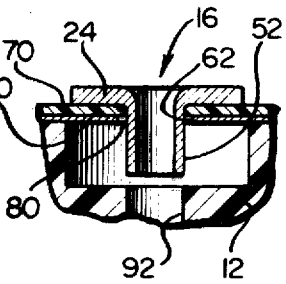
FIG. 5 is a cross-sectional view similar to FIG. 4 illustrating an alternative embodiment of the present invention.

Referring now to FIG. 5, an alternative embodiment is thereshown wherein the cylindrical members 52 are formed (e.g., "drawn" or "coined") from the planar portions 24 of the first contacts 16. As a result, individual cylindrical members are not required and a savings in manufacturing costs is afforded by this preferred embodiment. Again, the planar insulating member 70 is disposed between the first contact 16 and the second contact 60. The annular spaces 80 between the periphery of the cylindrical projections 52 and the periphery of the holes 62 of the second member 60 provides the desired spark gaps for affording surge voltage and current protection.

Figure 3:
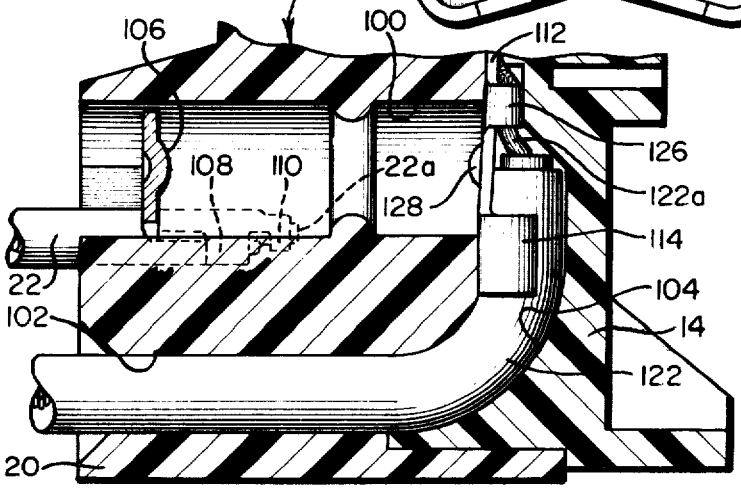
FIG. 3 is a partial cross-sectional view taken generally along lines 3—3 of FIG. 1.
Figure 6:
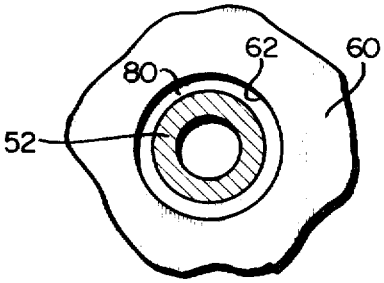
FIG. 6 is a cross-sectional view taken along line 6—6 of FIG. 4.
Figure 7:
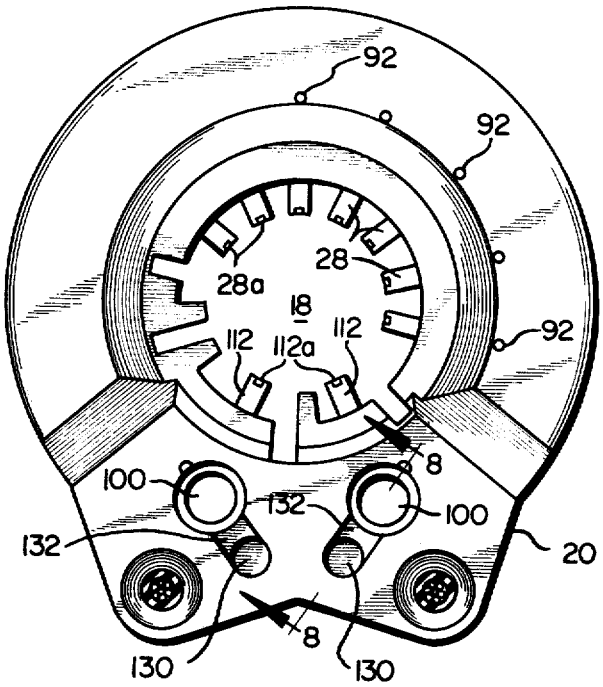
FIG. 7 is a front plan view of the socket of FIG. 1.
Figure 8:
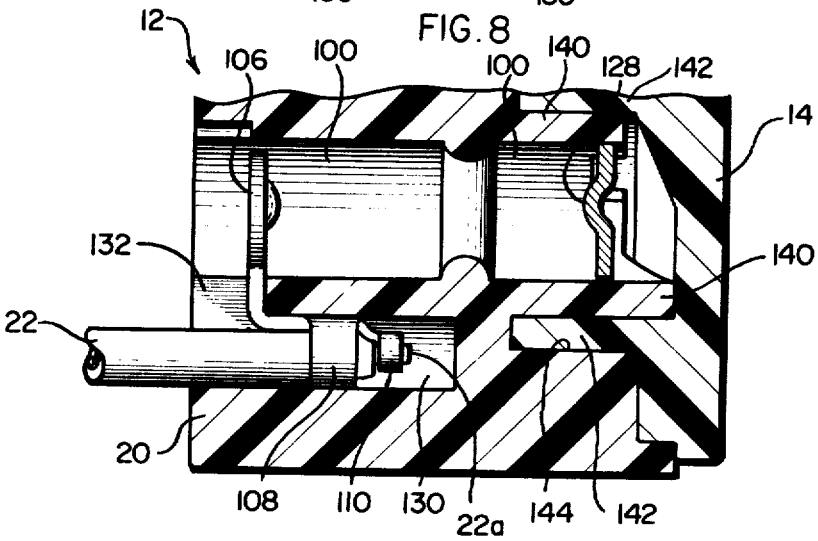
FIG. 8 is a partial cross-sectional view taken along lines 8—8 of FIG. 7.

As can be seen in FIGS. 4 and 5, the housing 12 of the socket 10 is provided with an enlarged bore 90 and a vent bore 92 communicating therewith. The enlarged bores 90 provide clearance for the cylindrical projections 52. The vent bores 92 extend to the front of the shell 12 (FIG. 7) into communication with the surrounding atmosphere to provide vents for the ozone created during arc-over. Referring now to FIGS. 3, 7 and 8, in accordance with another aspect of the present invention, the base 20 of the shell 12 includes a through bore or hollow shaft 100 and an associated cylindrical recess 130 communicating with the bore 100 by another recess 132. In actuality, there may be two or more such through bores 100 and associated recesses 130 and 132 provided within the shell 12, as may be seen, for example, in FIG. 7. Inasmuch as the structure of the through bore 100 and recesses 130 and 132 are identical in each case, only one such bore 100 and pair of recesses 130 and 132 are shown in section. The bore 100 is dimensioned to receive a third contact or ground electrode 106 which is attached to the ground cable 22 by a crimp 108. A second crimp 110 makes electrical contact between the conductor **22*a* of the cable 22 and the electrode 106. The electrode 106 extends from the crimp portion 108, through the recess 132, and into the bore 100** as shown.

Also provided within the base 20 of the shell 12 is another bore 102 which is dimensioned to receive a high-voltage insulated cable 122. For color television application of this invention, this voltage is approximately 15,000 to 25,000 volts.

As can be noted in FIG. 3, when the shell 12 and cover 14 are brought together in assembled relation, they define an extension of the bore 102 which curves upwardly at 104 to communicate with the bore 100. The cable 122 also includes a conductor **122*a* which is connected to a fourth contact 112 by a first crimp 114 which secures the contact 112 to the insulation of the cable 122, and a second crimp 126 which makes electrical connection between the contact 112 and the conductor 122*a*. The contact 112 includes an electrode portion 128 which is arranged for axial alignment with the electrode 106 within the bore 100. As a result, a high-voltage spark gap is formed between the electrodes 106 and 128. The contact 112 may, for example, project into the central opening 18 of the socket and include a similar wiper contact portion as the contact wiper portions 28 of the first contacts 16 and include slots 112*a*** in a similar manner.

As can also be noted in FIG. 3, when the shell 12 and cover 14 are brought together into assembled relation, the high-voltage cable 122 is securely clamped between the shell 12 and cover 14 in the curved section 104 of the bore 102. As a result, the cable 122 is held captive within the socket thereby providing strain relief for the high-voltage cable. Breakage of electrical continuity between the cable 122 and the contact 112 is thereby effectively precluded notwithstanding axial strains being subjected to the cable 122.

As can be further noted in FIG. 8, the shell 12 includes an annular wall portion 140. In a complementary manner, the cover 14 includes an annular or cylindrical wall portion 142 which extends towards the shell 12 and is received within an annular recess 144 provided in the shell 12 over the annular wall portion 140 of the shell. As a result, a concentric double-walled high-voltage spark gap chamber is formed to house the electrode 128. This double-walled construction provides a high-voltage spark gap chamber deep within the socket for confining the high-voltage contact 112, and more specifically its electrode portion 128, to provide a longer electrical path and thus minimize high-voltage breakdown or "breakout". Such high-voltage breakdown has been a problem with such sockets of the prior art.

Figure 9:
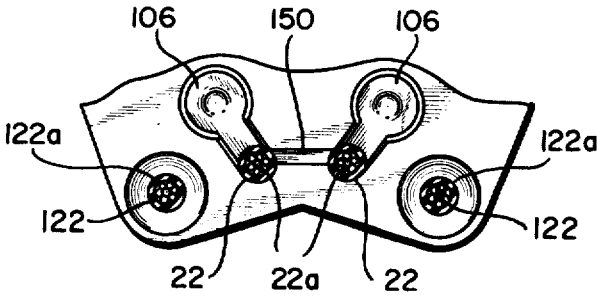
FIG. 9 is a partial front plan view of the socket illustrating the manner in which the ground contacts of the high voltage spark gaps may be tied together externally to the socket in accordance with a particular aspect of the present invention.

Referring now to FIG. 9, because access to the electrodes 106 is provided externally to the socket through the recesses 130 and 132 and the bore 100, the electrodes 106 may be electrically connected together by a strap 150. Hence, the ground contacts 106 may be utilized separately or be tied together. Furthermore, the electrode 106 and ground connecting cables 22 may be assembled apart from the socket and applied to the already assembled socket structure. This feature, along with the facility to adjust the spacing between the electrode 106 and 128 by controlling the degree in which the electrode 106 extends within the bore 100 or by simply adjusting the link of the mold core pins, allows flexibility of manufacture permitting assembly of the inventive socket before custom adjustment of high-voltage parameters. This is particularly important inasmuch as a primary variation among such sockets is the high-voltage spark gap breakdown.

From the foregoing, it can be appreciated that the present invention provides a new and improved socket for making electrical connections to the pins on the neck of a cathode ray tube. The socket of the present invention provides for the accurate positioning of the spark gap elements to thereby provide uniformly dimensioned spark gaps and desired spark gap breakdown voltages. More specifically, with reference to FIG. 5, the relative positioning of the first contacts 24, the insulator 70, and ground plate 80 is achieved by the cylindrical projections 52 being drawn or extruded from the ground plate or second conductive contact 60 relative to the insulator 70 and the first contacts 24 by means of the cylindrical members 52 also relate to the insulator 70 in proper orientation. Hence, both contacts 24 and 60 are located relative to the insulator 70 allowing accurate positioning for the provision of uniform spark gaps.

It also can be appreciated that the socket of the present invention provides a new and improved spark gap structure for protecting external circuitry connected thereto from the surge voltages and currents resulting from arcing which would otherwise occur within the cathode ray tubes on which they are employed. Because the spark gaps are formed by a pair of annular surfaces, and more specifically between the peripheries of the cylindrical members 52 and the peripheries of the holes 62 within the second contact 60, sharp edges or other irregularities which would otherwise affect the consistent operation of the spark gaps are minimized. Furthermore, if it is desired to increase or decrease the spark over voltage, it is only necessary to vary the diameter dimension of the holes 62 accordingly, a matter that is relatively simple and economical.

Another particular advantage of the present invention resides in the fact that rigit support is provided for the terminal extensions 26 which extend axially and rearwardly from the socket 10. As a result, secure support of a printed circuit board or the like is afforded. Lastly, because the cylindrical members 52 may be integrally formed from the first contacts 16, by drawing or coining, and because the second conductive contact is common to each of the spark gaps, the number of individual component parts for forming the spark gaps within the socket 10 is substantially reduced. As a result, the socket of the present invention may be economically manufactured. While a particular embodiment of the present invention has been shown and described, modifications may be made, and it is therefore intended to cover in the appended claims all such changes and modifications which fall within the true spirit and scope of the invention.

The invention is claimed as follows:

1. In a socket for making electrical connections to the pins on the neck of a cathode ray tube, the improvement comprising: a plurality of first conductive contacts for engaging said pins, each of said contacts having an elongated planar portion a part of which is integrally formed into a cylindrical projection from the plane of said elongated portion; a second conductive contact having a planar surface spaced parallel to said planar portion of said first contact with a corresponding plurality of holes therein, with each of said holes having a diameter larger than that of the corresponding cylindrical projection, for receiving the corresponding ones of said cylindrical projections; and a planar insulating member positioned between said first and second conductive contacts and having a corresponding plurality of holes therein, with each said hole having a diameter smaller than said corresponding hole in said planar conductive contact but at least as large as the diameter of said corresponding cylindrical projection, whereby a spark gap is formed radially from each said cylindrical projection to the periphery of each said hole in said second contact; and further including a substantially ring-shaped housing having a central opening, with a predetermined axial dimension defining a cylindrical inner surface and wherein said inner surface includes a plurality of axial slots for receiving and positioning said contact portions within said central opening, for receiving the cathode ray tube neck; and wherein said first contacts are circularly arranged with each said first contact including a portion projecting into said central opening for engaging the cathode ray tube pins; and wherein said housing includes a plurality of slotted terminal support means radially spaced from said cylindrical projections and extending axially from said housing, and wherein each of said first contacts includes a terminal extension extending axially from said first contact elongated planar portion and received within said slotted terminal support means.

2. A socket as defined in claim 1 further including a substantially ring-shaped cover for enclosing said second contact and said first contact elongated planar portions within said housing.

3. A socket as defined in claim 2 wherein said cover includes radially projecting portions arranged to be received within said slotted support means when assembled to said housing for lending rigidity to said terminal extensions.

4. A socket as defined in claim 1 wherein said housing further includes a base portion having a through bore, and wherein said socket further includes a third contact having an elongated portion extending transversely across said bore, a contact portion extending into said central opening for engaging a corresponding pin of the cathode ray tube, and a first electrode carried by said elongated portion and facing axially into said bore; and a fourth contact disposed within said bore and having a second electrode facing said first electrode, said first and second electrodes forming a secondary spark gap for voltages substantially higher than those for said first and second conductive contacts.

5. A socket as defined in claim 4, and further including a substantially ring-shaped cover arranged for engaging said housing in assembled relation, wherein said housing includes a first annular wall means defining a portion of said through bore, and wherein said cover includes a second annular wall means arranged to be received over said first wall means when said housing and said cover are assembled for providing a double wall chamber for said first electrode within said through bore to thereby substantially minimize high-voltage breakdown within said socket.

6. A socket as defined in claim 4 wherein said third contact is further adapted to be connected to a high-voltage conductor extendable through said through bore and wherein said fourth contact is adapted to be connected to a ground-connecting conductor.

7. A socket as defined in claim 4 further including a substantially ring-shaped cover arranged for engaging said housing in assembled relation and wherein said housing and said cover define a curved extension of said through bore, and strain relief means adapted for supporting a high-voltage conductor within said curved extension when in said assembled relation.

* * * * *